US009624800B2

(12) United States Patent
Noller et al.

(10) Patent No.: US 9,624,800 B2
(45) Date of Patent: Apr. 18, 2017

(54) VAPORIZER

(71) Applicant: Faurecia Emissions Control Technologies, Germany GmbH, Augsburg (DE)

(72) Inventors: Christoph Noller, Konigsbrunn (DE); Juergen Klement, Asbach-Baumenheim (DE); Otto Steinhauser, Neusaess (DE); Toni Zipfel, Meitingen (DE); Tobias Danner, Neu-Ulm (DE)

(73) Assignee: Faurecia Emissions Control Technologies, Germany, GmbH, Augsburg (DE)

( * ) Notice: Subject to any disclaimer, the term of this patent is extended or adjusted under 35 U.S.C. 154(b) by 345 days.

(21) Appl. No.: 14/195,219

(22) Filed: Mar. 3, 2014

(65) Prior Publication Data

US 2014/0248042 A1 Sep. 4, 2014

(30) Foreign Application Priority Data

Mar. 4, 2013 (DE) ..... 10 2013 102 120

(51) Int. Cl.
*F22B 29/06* (2006.01)
*A01G 13/06* (2006.01)
(Continued)

(52) U.S. Cl.
CPC ..... *F01N 3/0253* (2013.01); *F01N 3/36* (2013.01); *F01N 2610/00* (2013.01);
(Continued)

(58) Field of Classification Search
None
See application file for complete search history.

(56) References Cited

U.S. PATENT DOCUMENTS 5,400,969 A * 3/1995 Keene ..... B05B 1/24 219/205
5,401,935 A * 3/1995 Smith ..... F02M 57/00 219/206

(Continued)

FOREIGN PATENT DOCUMENTS

DE 19941577 A1 3/2001

*Primary Examiner* — Thor Campbell
(74) *Attorney, Agent, or Firm* — Carlson, Gaskey & Olds, PC

(57) ABSTRACT

A vaporizer for an exhaust system of an internal combustion engine has a vaporizer tube and a holding sleeve in which the vaporizer tube is inserted. A clamping sleeve sits on the vaporizer tube. The vaporizer tube includes two circumferentially surrounding clamping surfaces which protrude in a radial direction and cooperate with the holding sleeve and the clamping sleeve such that the clamping surfaces are clamped between the holding sleeve and the clamping sleeve by an axial clamping force to be gastight. At least one of the holding sleeve and the clamping sleeve includes a surrounding sealing edge which rests against the respective clamping surface via a line contact and forms an annular sealing seat. The vaporizer further includes a device preventing relative rotation between the holding sleeve and the vaporizer tube. A heater of the vaporizer is attached to the vaporizer tube using a resistance welding method.

17 Claims, 4 Drawing Sheets

(51) Int. Cl.
*F01N 3/025* (2006.01)
*F01N 3/36* (2006.01)

(52) U.S. Cl.
CPC .... *F01N 2610/10* (2013.01); *F01N 2610/107* (2013.01); *F01N 2610/1453* (2013.01)

(56) References Cited

U.S. PATENT DOCUMENTS

| | | | | |
|---|---|---|---|---|
| 6,332,457 | B1 * | 12/2001 | Imoehl | F02M 53/06 123/179.21 |
| 7,681,558 | B2 * | 3/2010 | Gale | F02D 41/0025 123/490 |
| 8,281,570 | B2 * | 10/2012 | Gierszewski | F01N 3/2066 60/274 |
| 2004/0098976 | A1 * | 5/2004 | van Nieuwstadt | F01N 3/035 60/286 |
| 2008/0066448 | A1 * | 3/2008 | Halbei | F01N 3/2066 60/282 |
| 2010/0170229 | A1 * | 7/2010 | Venghaus | B01D 53/90 60/295 |
| 2013/0188444 | A1 | 7/2013 | Palmer et al. | |

* cited by examiner

Fig. 1
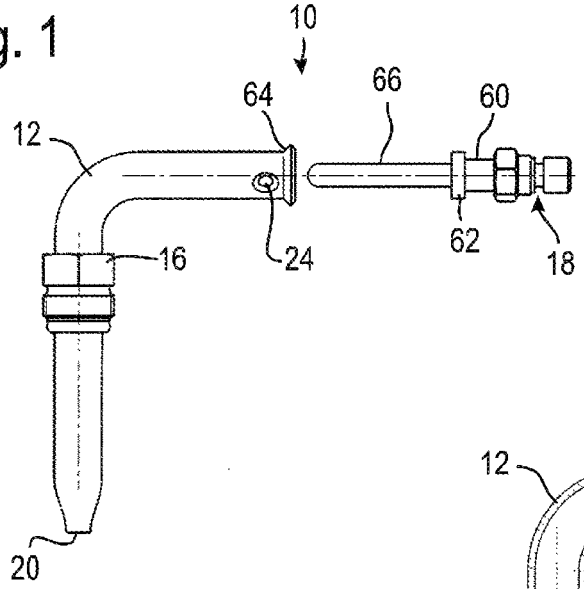
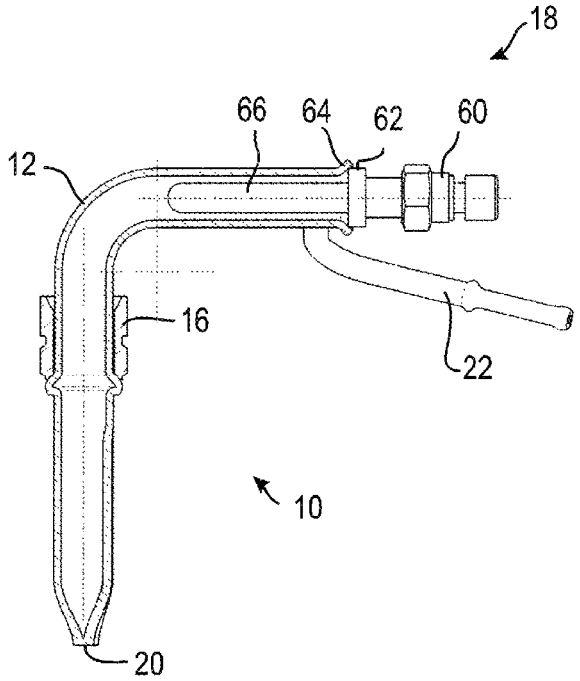
Fig. 2
Fig. 3
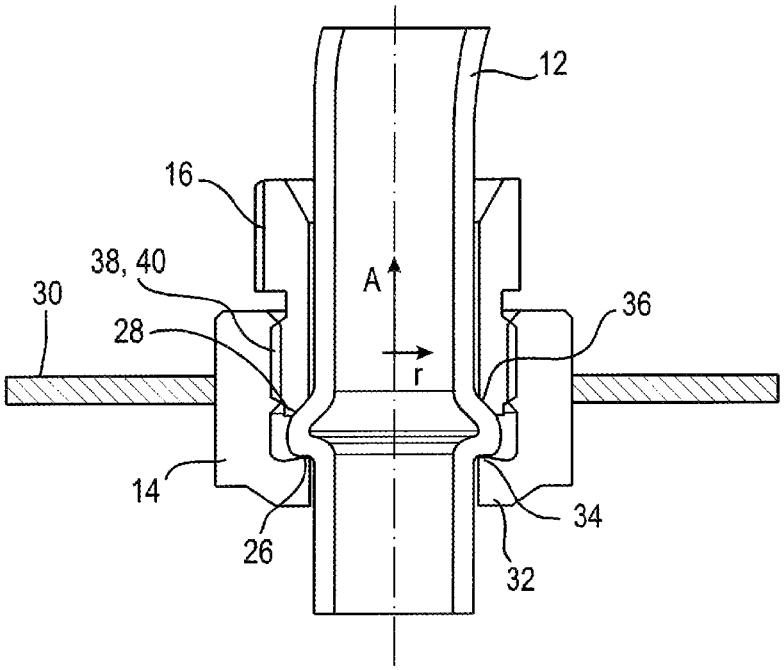

Fig. 4
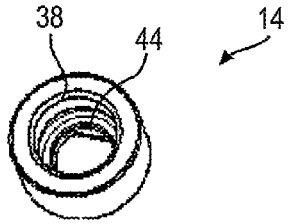
Fig. 5
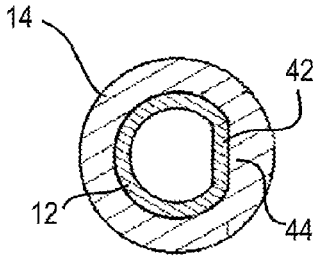
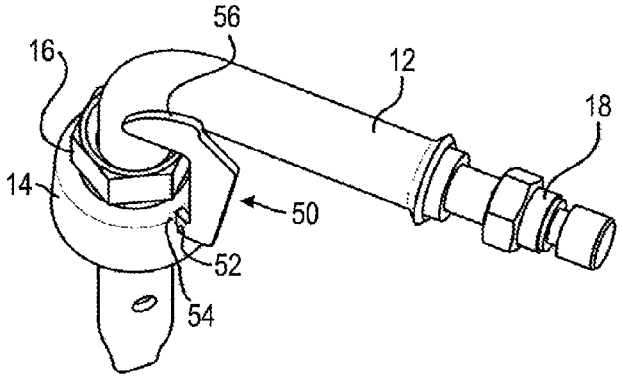
Fig. 6
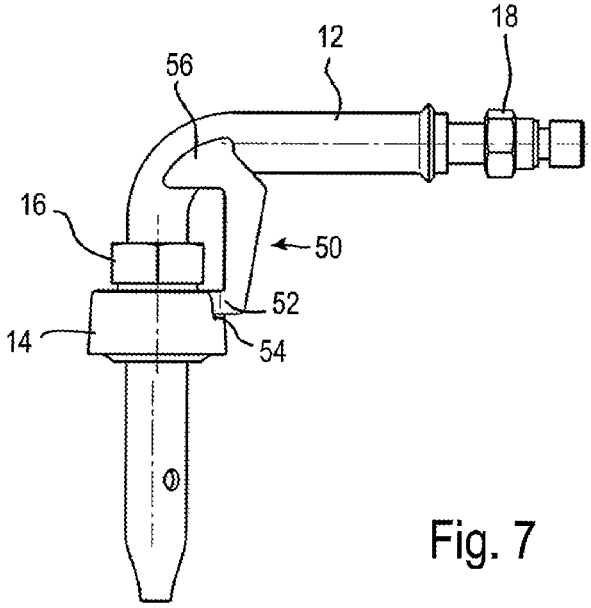
Fig. 7

Fig. 8
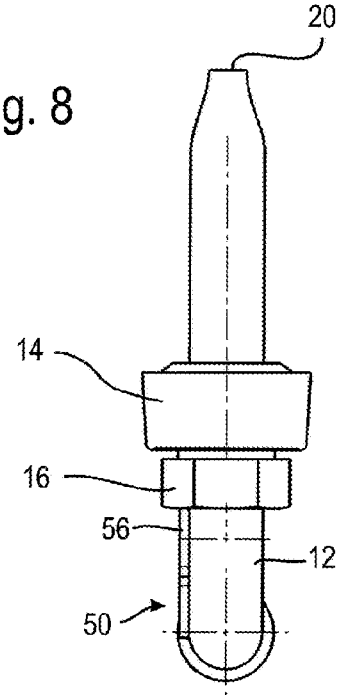
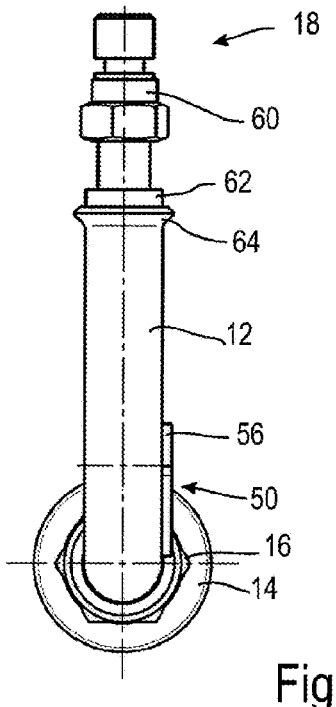
Fig. 9
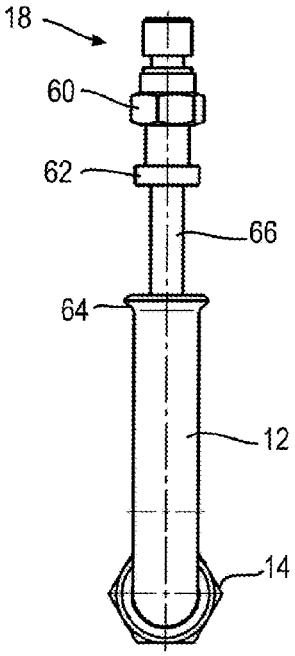
Fig. 10
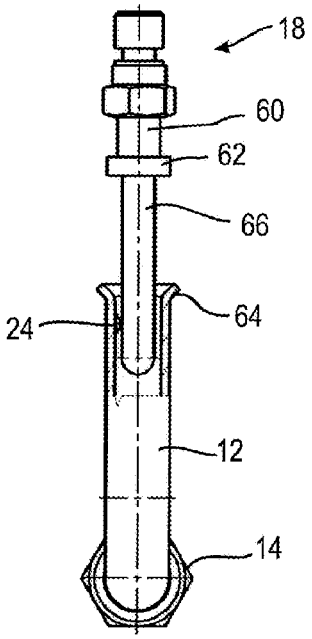
Fig. 11

VAPORIZER

RELATED APPLICATION

This application claims priority to DE 10 2013 102 120.4, filed 4 Mar. 2013.

TECHNICAL FIELD

The present invention relates to a vaporizer for an exhaust system of an internal combustion engine.

BACKGROUND

Vaporizers of this type are made use of, for example, to introduce fuel into an exhaust pipe of a diesel combustion engine for regeneration of a particulate filter or a $NO_x$ storage catalytic converter.

The vaporizer typically includes a heating device, in most cases a glow plug, for heating the liquid to be vaporized. The heating device is accommodated in a vaporizer tube which needs to be connected with the exhaust pipe in a gastight manner since an end section of the vaporizer tube projects into the exhaust pipe for introducing the vaporized liquid.

There is a need to provide a low-cost, gastight connection which is simple to manufacture, between the vaporizer and a tube of an exhaust pipe, for example.

SUMMARY

A vaporizer for an exhaust system of an internal combustion engine includes a vaporizer tube and a holding sleeve in which the vaporizer tube is inserted. A clamping sleeve sits on the vaporizer tube. The vaporizer tube includes two circumferentially surrounding clamping surfaces which protrude in a radial direction and cooperate with the holding sleeve and the clamping sleeve such that the clamping surfaces are clamped between the holding sleeve and the clamping sleeve by an axial clamping force to be gastight. At least one of the holding sleeve and the clamping sleeve includes a surrounding sealing edge which rests against the respective clamping surface by means of a line contact and forms an annular sealing seat. Advantageously, the clamping sleeve is axially displaceable in relation to the holding sleeve to be able to generate an axial clamping force. When the axial clamping force is applied, the surrounding sealing edge comes into contact with one of the two clamping surfaces, so that a gastight connection is produced between the sealing edge and the clamping surface.

The wall of the vaporizer tube is preferably of a single-wall design and has a material thickness of more than 0.9 mm, so that it is ensured that the sealing edge can come into uniform contact with the clamping surface over an entire circumference, without the clamping surface being overly deformed when the necessary clamping forces are applied.

The sealing edge is preferably made so sharp-edged that it digs into the clamping surface for sealing. In this way, the line contact is ensured and a good sealing effect is obtained.

In one example, the holding sleeve is attached to be vehicle-fixed, for example inserted in a gastight manner in an opening of an exhaust pipe.

In one example, the vaporizer tube constitutes an outer housing of the vaporizer and surrounds a heating element arranged in the vaporizer tube, and at the same time also constitutes a vaporizer chamber and an outlet tube for the vaporized liquid. Apart from the vaporizer tube, the vaporizer preferably includes no further housing parts.

The clamping surfaces can be produced in a simple fashion by a combined axial/radial forming on the wall of the vaporizer tube, whereby sections of the wall are pushed radially outward, so that a circumferentially surrounding bulge that is directed radially outward is produced in the wall of the vaporizer tube. The two clamping surfaces are then defined by the outer surfaces of the bulge. The wall thickness of the vaporizer tube preferably remains substantially unchanged in the bulge in the area of the clamping surfaces compared with its original wall thickness.

The inner side of the wall of the vaporizer tube may, for example, be curved outward approximately in a V-shape in the area of the clamping surfaces. The two surfaces of the inner wall corresponding to the clamping surfaces are preferably spaced from each other. This has the advantage that it is possible to design the clamping surfaces to be elastically movable relative to each other in the axial direction.

The two clamping surfaces may extend at different angles in relation to the radial direction. Preferably, that one of the clamping surfaces which cooperates with the sealing edge is substantially flat and, more particularly, oriented roughly at an angle of 90 degrees to the axial direction of the vaporizer tube. The second clamping surface, on the other hand, is preferably inclined at an angle of between 30 degrees and 75 degrees, in particular between 45 degrees and 60 degrees, in relation to the axial direction.

A particularly good clamping effect is produced if the clamping sleeve or the holding sleeve which rests against the inclined clamping surface having, more particularly, a frustoconical shape, has a conical tensioning surface having an inclination that is more particularly adapted to that of the clamping surface. When the clamping surfaces move in relation to each other during tightening of the clamped connection, the inclination of the conical tensioning surface should correspond to the inclination of the respective clamping surface in the completely tightened condition of the clamped connection.

A simple and stable clamped connection can be achieved, for example, with a holding sleeve including an internal thread and a clamping sleeve including an external thread complementary thereto. The clamping sleeve is preferably a hollow bolt having a central opening through which the vaporizer tube extends. The holding sleeve can be simply inserted into an opening in the exhaust pipe in a firm and gastight manner. The holding sleeve may, e.g., be welded into the opening. To produce the clamped connection, it is only required to thread the clamping sleeve into the holding sleeve until the sealing edge that is preferably formed on the holding sleeve and the clamping surfaces have reached their final positions, in which a gastight connection is provided.

In this case, the conical tensioning surface and the inclined clamping surface are preferably arranged such that the cones open toward the inside of the exhaust pipe. This has the advantage that when the components are heated, the threaded connection is automatically tightened due to the differences in thermal expansion. In a cold start of the internal combustion engine, the holding sleeve inserted in the exhaust pipe will, by nature, heat up more quickly than the clamping sleeve and will also assume a higher final temperature. In the course of the heating process, the holding sleeve will expand radially in relation to the clamping sleeve. In the process, the thread of the clamping sleeve slides along the thread flanks of the holding sleeve, which is tantamount to a loosening of the threaded connection. This thermal setting is, however, compensated for by a countermovement of the clamping sleeve along the inclined clamping surface. The contacting thread flanks of the holding sleeve and of the clamping sleeve as well as the conical tensioning surface and the inclined clamping surface should therefore be oriented substantially in the same direction and, as viewed relative to the center axis of the clamping sleeve, should have a similar, more particularly the same, angle of inclination.

A further object of the invention is to facilitate the insertion of the vaporizer into an exhaust pipe in a predetermined position and to ensure that the position of the vaporizer cannot change in the course of use of the internal combustion engine.

This is achieved according to the invention in a vaporizer including a vaporizer tube which is inserted in a holding sleeve in particular on an exhaust pipe, a form-fitting anti-rotation device being provided which prevents the vaporizer tube and the holding sleeve from rotating relative to each other.

Such an anti-rotation device can also be made use of advantageously in one of the above-described vaporizers.

A form-fitting connection can be simply produced directly when the vaporizer is mounted to the exhaust pipe, so that the installation of the vaporizer in the predetermined position is ensured without any additional expenditure. Due to the form fit, any movement of the vaporizer tube such as, e.g., because of vibrations of the internal combustion engine or of a vehicle in which the internal combustion engine is located is also ruled out.

The anti-rotation device may be formed, for example, by a flat portion of the otherwise circular cross-section of the vaporizer tube.

The holding sleeve preferably includes a projection shaped complementary to the flat portion. Advantageously, the flat portion can be formed in an axial section of the vaporizer tube immediately below the clamping surfaces, in order that the holding sleeve can be short in the axial direction.

An anti-rotation device of this type is simple and cost-effective to produce. It requires no additional assembly effort and provides a reliable protection from rotation.

The flat portion can be manufactured in one work step together with the forming of the vaporizer tube to produce the two clamping surfaces.

In a different variant, the anti-rotation device includes a plate-shaped retaining part having a section that is firmly connected with one of the vaporizer tube and the holding sleeve, and having a second section that engages in a recess on one of the holding sleeve and the vaporizer tube. The two sections may be configured on the respective ends of the retaining part. The retaining part here is preferably located outside of the holding sleeve and the vaporizer tube.

The retaining part is preferably a stamped sheet metal part and is advantageously bent, so that a prestress builds up between the first and second sections, which fixes the vaporizer tube in place.

The recess is in the form of a groove in the holding sleeve, for example, into which the second section of the retaining part is fitted. If possible, here the dimensions of the groove are only slightly larger in the circumferential direction than the width of the second section of the retaining part. This allows a reliable clamping effect to be achieved.

The first section of the retaining part is preferably firmly welded to the outside of the vaporizer tube. For a simplified assembly, the retaining part is advantageously attached to the vaporizer tube before the vaporizer is mounted to the exhaust tube. The vaporizer tube is inserted into the holding sleeve such that the second section of the retaining part engages in the recess on the holding sleeve. Subsequently, the clamping sleeve is tightened and the vaporizer is fixed in its predetermined position.

A reverse design could, of course, also be used, in which the retaining part is firmly attached to the holding sleeve, for example by welding, and is fixed in place by engaging a recess formed on the vaporizer tube.

Another object of the invention is to optimize the attachment of a heater, in particular a glow plug, to the vaporizer tube.

In a method of manufacturing a vaporizer this is achieved in that an outer surface of a holder of the heater, in particular a glow plug, and an inner surface of the vaporizer tube are connected to each other by a resistance welding method such as capacitor discharge or capacitor pulse welding or annular projection welding. Such a connection allows a quick and yet long-lasting gastight connection between the components. It has been found that using the above-mentioned methods, a connection of good quality can be achieved between a glow plug and the vaporizer tube, for example, although only a relatively small total amount of energy needs to be supplied, so that the components to be connected are heated only to a minor degree.

It is also possible to readily apply these methods to vaporizers as have been described above.

In a preferred geometry, the vaporizer tube includes an end section which is flared in a funnel shape and in which a heater having a holder with a cylindrical section is inserted, an outer edge of the cylindrical section being welded to the inside of the funnel-shaped end section. Such geometric relationships result in a line contact between the inside of the wall of the vaporizer tube and the outside of the holder of the heater, something which is very well suited especially for resistance welding methods such as capacitor discharge or capacitor pulse welding since an even, high current flow can be achieved at this point, resulting in a high-quality welded joint.

Owing to the funnel shape, a self-centering of the cylindrical section occurs, so that a line contact is always ensured.

Conversely, it is also possible to provide a conical section on the holder of the heater and a circular edge or shoulder in the end section of the vaporizer tube. In this case, too, a self-centered continuously surrounding line contact is always obtained, which can be utilized, e.g., for a capacitor discharge welding.

A supply pipe for liquid to be vaporized, which preferably opens into the vaporizer tube in the area of the heater, may be welded with a similar geometry to the edge of an opening in the circumferential surface of the vaporizer tube, preferably also by a resistance welding method such as capacitor discharge welding. Here, the edge of the opening in the vaporizer tube can be conically beveled, for example, whereas the tube end has an opening with a circular edge.

The present invention may be used for exhaust systems of any type of internal combustion engine, for example in passenger cars or trucks. Other applications relate to railway engines and stationary internal combustion engines as are used for emergency power systems, for example.

These and other features may be best understood from the following drawings and specification.

BRIEF DESCRIPTION OF THE DRAWINGS

The invention will now be described in more detail below on the basis of several embodiments and with reference to the accompanying drawings, in which:

FIG. 1 shows a schematic exploded side view of a vaporizer according to the invention;

FIG. 2 shows a schematic partial sectional view of a portion of a vaporizer according to the invention;

FIG. 3 shows a schematic sectional view of a portion of the vaporizer according to the invention, showing the attachment of the vaporizer tube;

FIG. 4 shows a schematic perspective view of a holding sleeve with an anti-rotation device according to a first variant for a vaporizer according to the invention;

FIG. 5 shows a schematic sectional view of a vaporizer according to the invention, with an anti-rotation device according to a first variant;

FIGS. 6 to 9 show various schematic perspective views of a vaporizer according to the invention, with an anti-rotation device according to a second embodiment;

FIG. 10 shows a schematic side view of a vaporizer according to the invention, with an associated heater prior to attachment of the heating means;

FIG. 11 shows a schematic perspective view, partly in section, of the assembly of FIG. 10.

DETAILED DESCRIPTION

Figure 12:
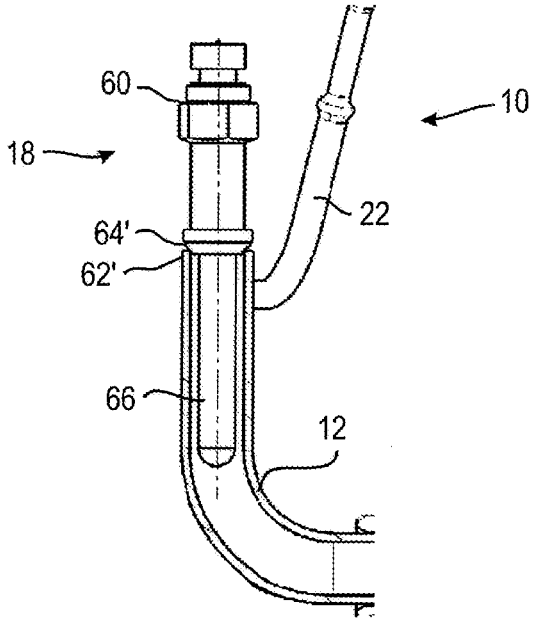
FIG. 12 shows a schematic partial sectional view of a portion of a vaporizer according to a further embodiment of the invention.

FIGS. 1 and 2 show a vaporizer 10 which in this example includes a vaporizer tube 12 bent at right angles, which is surrounded in the circumferential direction by a clamping structure in the form of a holding sleeve 14 and a clamping sleeve 16 (see FIG. 3).

The vaporizer tube 12 need not be bent as illustrated here. It could also be completely straight or be designed with a curvature profile different from the one shown.

A heater 18, here shown separately from the vaporizer tube 12, is attached to one end of the vaporizer tube, also referred to as the upper end here. In this example, the heater 18 is a known glow plug. At its other end, the vaporizer tube 12 includes an outlet 20 for the liquid vaporized by the heater 18.

The liquid to be vaporized, for example liquid fuel as is also used for the internal combustion engine in the exhaust system of which the vaporizer 10 is employed, is introduced into the vaporizer tube 12 through a supply pipe 22 which is connected to an opening 24 in the vaporizer tube 12 (see FIG. 2), where the liquid is heated by the heater 18 and vaporized. The vaporized liquid exits the vaporizer tube 12 through the outlet 20 and thus reaches the exhaust gas flow.

FIG. 3 shows the clamping device with the holding sleeve 14 and the clamping sleeve 16 in detail.

Two clamping surfaces 26, 28 are formed on the vaporizer tube 12, at the level of the holding sleeve 14 and the clamping sleeve 16.

In this example, the first clamping surface 26 is in the form of an annular surface which is oriented substantially in a plane perpendicular to the axial direction A of the vaporizer tube 12.

The second clamping surface 28 (in FIG. 3 the upper clamping surface), on the other hand, has the shape of a truncated cone. The internal angle defining the cone lies on the side facing away from the first clamping surface on the center axis of the vaporizer tube 12 and opens toward the interior of the exhaust pipe 30. As seen in section, the second clamping surface 28 is oriented here at an angle of between 45 degrees and 60 degrees to the axial direction A. But the angle may, of course, also be selected differently.

The two clamping surfaces 26, 28 are produced by an axial upsetting along with a simultaneous radial widening of the vaporizer tube 12. Under the action of the axial force, the wall of the vaporizer tube 12 bulges radially outward, accompanied by the formation of the two clamping surfaces 26, 28, partly extending flatly, on the outside of the vaporizer tube 12.

The deformation of the vaporizer tube 12 is performed such that those wall sections of the inside of the vaporizer tube 12 which correspond to the clamping surfaces 26, 28 do not lie on top of each other, but have an axial distance.

The wall thickness of the vaporizer tube 12 is selected such that the two clamping surfaces 26, 28 can be elastically moved relative to each other axially when the clamped connection is produced. However, the wall thickness of the vaporizer tube 12 is preferably greater than 0.9 mm, so that the vaporizer tube 12 has a sufficient stability by itself, without any further aids having to be provided for stabilization in particular in the area of the clamped connection. Above all, no further inner or outer tube is provided. In the examples described here, the vaporizer 10 consists of the components shown in the Figures.

The holding sleeve 14 is welded into a wall of an exhaust pipe 30 which is part of the exhaust system of the internal combustion engine. As a result, the holding sleeve 14 is fastened to be stationary.

The vaporizer tube 12 protrudes through the holding sleeve 14 such that its outlet 20 opens into the interior of the exhaust pipe 30.

The holding sleeve 14 has an annular seat 32 which, in the assembled state, is arranged immediately below the first clamping surface 26 and here rests against the outer wall of the vaporizer tube 12. On its side facing the clamping surface 26, this seat 32 has a surrounding, sharp sealing edge 34 which is arranged radially at the level of the clamping surface 26. "Sharp" means here that the sealing edge 34 is configured without the otherwise usual edge radii or has a very small edge radius, so that a high contact surface pressure is obtained upon contact with the clamping surface.

In FIG. 3, the clamping sleeve 16 is positioned above the upper clamping surface 28 and includes a conical tensioning surface 36 which is arranged at its lower end in FIG. 3 and which, in the assembled condition, rests against the clamping surface 28. In the completely tightened condition of the clamped connection, the inclinations of the conical tensioning surface 36 and the clamping surface 28 are substantially the same.

The two clamping surfaces 26, 28 therefore lie between the sealing edge 34 of the seat 32 of the holding sleeve 14 and the conical tensioning surface 36 of the clamping sleeve 16.

The holding sleeve 14 includes an internal thread 38 while the clamping sleeve 16, which is in the form of a hollow bolt here, has an external thread 40.

The angles of inclination of the thread flanks of the internal thread 38 and of the external thread 40 and the angles of inclination of the clamping surface 28 and of the conical tensioning surface 36, each viewed relative to the center axis, may be selected to be the same. In this example, however, the clamping surface 28 has an angle of inclination of 45 degrees, while the threads 38, 40 have an angle of inclination of 60 degrees.

To attach the vaporizer tube 12, it is inserted with the clamping sleeve 16 placed thereon into the holding sleeve 14, which preferably has previously been attached to the exhaust pipe 30, so that the lower clamping surface 26 rests on the sealing edge 34 of the holding sleeve 14. Then the clamping sleeve 16 is threaded into the thread 38 of the holding sleeve 14, the conical tensioning surface 36 coming into contact with the upper clamping surface 28, so that the two clamping surfaces 26, 28 are firmly clamped between the holding sleeve 14 and the clamping sleeve 16. In this process, the two clamping surfaces 26, 28 are slightly compressed in the axial direction A.

In addition, since the sealing edge 34 is made with a sharp edge, it cuts into the lower clamping surface 26 along a surrounding line, so that a gastight connection is produced here between the holding sleeve 14 and the clamping surface 26 and thus the vaporizer tube 12 by the sealing edge 34 penetrating the material of the clamping surface 26. As a result, there is a gastight connection between the vaporizer tube 12 and the exhaust pipe 30.

The vaporizer 10 has an anti-rotation device provided thereon which, in the installed state, prevents the vaporizer tube 12 from rotating in relation to the exhaust pipe 30.

In the variant shown in FIGS. 4 and 5, the otherwise circular cross-section of the vaporizer tube 12 is deformed at one point of the circumference below the first clamping surface 26 so as to form a flat portion 42. In this example, the flat portion extends approximately over an inscribed angle (sector) of 60 degrees.

Below the sealing edge 34, the holding sleeve 14 includes a projection 44 which is directed radially inwards and the contour of which matches that of the flat portion 42 in the vaporizer tube.

When the vaporizer tube 12 is inserted into the holding sleeve 14 such that the flat portion 42 rests against the projection 44, this results in a form fit which prevents the vaporizer tube 12 from rotating in relation to the holding sleeve 14 and thus in relation to the exhaust pipe 30. Moreover, the combination of the flat portion 42 and the projection 44 makes sure that the vaporizer tube 12 can only be installed in exactly this single predefined position with respect to a holding sleeve 14 that is already attached in the exhaust pipe 30.

FIGS. 6 to 9 show a second variant of an anti-rotation device.

In this case, provision is made for a retaining part 50 which is in the form of a partly bent, stamped sheet metal part and is located outside of the vaporizer tube 12 and the holding sleeve 14, and which is separate from these components. At the lower end in FIGS. 6 and 7, a first section 52 of the retaining part 50 is shaped into a flattened web which engages in an only slightly wider recess 54 in the outer circumference of the holding sleeve 14. This produces a form-fitting push-in connection.

The end of the retaining part 50 which is the upper end in FIGS. 6 and 7 constitutes a second section 56 in the form of a plate-shaped widening which here rests against the outer wall of the vaporizer tube 12 in the region of the curvature thereof and is firmly connected, for example welded, to the outer wall.

The retaining part 50 is slightly curved in front of the second section 56, so that a mechanical prestress exists between the first section 52 and the second section 56, as a result of which the first section 52 is fixed in place in the recess 54.

In the examples shown here, the heater 18 and the vaporizer tube 12 are attached to one another by a resistance welding method or resistance pressure welding method, in particular by capacitor discharge or pulse welding or annular projection welding.

At one end, the heater 18 has a metallic holder 60 which has a rod-shaped heating source 66 inserted therein and attached thereto. The heating source 66 is a conventional glow plug here, which is closed to the outside by a glow tube, for example. Any additional housing for the heating source is not provided. The free end of the heating source 66 projects from the holder 60. At its end facing the free end of the heating source 66, the holder 60 includes a cylindrical section 62, which has a larger diameter than the heating source 66.

The upper end of the vaporizer tube 12 is conically flared, as is apparent in particular from FIGS. 2, 9, 10 and 11. The diameter of the vaporizer tube 12 at the start of the end section 64 flared in a funnel shape is smaller than the diameter of the cylindrical section 62, whereas the upper end of the flared end section 64 has a larger diameter than the cylindrical section 62. Consequently, the heating means 18 is automatically centered when it is inserted into the vaporizer tube 12, and a line contact is produced between the sharp edge of the cylindrical section 62 and the inner wall of the vaporizer tube 12. This contact line encircling the entire circumference is made use of for the capacitor discharge welding in order to produce a welded joint at this location.

When the heater has been attached, the heating source 66 projects into the vaporizer tube 12 and is spaced away from the inside of the vaporizer tube 12 over its entire circumference.

FIG. 12 shows a variant in which the holder 60 of the heater 18 includes a conical section 64' whereas, in return, the edge of the opening of the vaporizer tube 12 forms a sharp, circular ring shaped edge 62'. In this case, too, a self-centering of the heater 18 is effected upon insertion into the open end of the vaporizer tube 12, so that a circumferentially encircling line contact is produced between the vaporizer tube 12 and the holder 60. This geometry is also suited for a connection by capacitor discharge welding.

Both the vaporizer tube 12 and the holder 60 of the heater 18 are made from metal, so that a good electrical conductivity for capacitor discharge welding is given.

The principle set out above of a sharp circular edge and a conically shaped contact surface to produce a geometry that is well suited for capacitor discharge welding can also be applied to the attachment of the supply pipe 22 in the opening 24 in the vaporizer tube 12. The edge of the opening 24 is preferably beveled here, and the end of the supply pipe 22 has a circular ring shaped edge.

All of the features described herein may be combined with or exchanged for each other at the discretion of a person skilled in the art.

The various aspects of the invention, more specifically the attachment of the vaporizer 10 to the vaporizer tube 12, the holding sleeve 14 and the clamping sleeve 16 by a clamped connection using clamping surfaces 26, 28, the provision of an anti-rotation device for the vaporizer tube 12, and the attachment of the heater 18 to the vaporizer tube 12 by capacitor discharge welding may be realized both separately on any desired vaporizers or may also be employed jointly on one vaporizer.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A vaporizer for an exhaust system of an internal combustion engine, comprising:

a vaporizer tube;

a holding sleeve in which the vaporizer tube is inserted, wherein the holding sleeve is associated with an exhaust pipe, and wherein a form-fitting anti-rotation device is provided which prevents the vaporizer tube and the holding sleeve from rotating relative to each other; and a clamping sleeve which sits on the vaporizer tube wherein the vaporizer tube includes two circumferentially surrounding clamping surfaces which protrude in a radial direction and cooperate with the holding sleeve and the clamping sleeve such that the clamping surfaces are clamped between the holding sleeve and the clamping sleeve by an axial clamping force to be gastight, and wherein at least one of the holding sleeve and the clamping sleeve includes a surrounding sealing edge which rests against the respective clamping surface via line contact and forms an annular sealing seat.

2. The vaporizer according to claim 1, wherein the sealing edge has a sharp edge that digs into the clamping surface for sealing.

3. The vaporizer according to claim 1, wherein the clamping surfaces are elastically movable relative to each other in an axial direction.

4. The vaporizer according to claim 1, wherein the two clamping surfaces extend at different angles in relation to the radial direction.

5. The vaporizer according to claim 1, wherein at least one of the clamping sleeve and the holding sleeve includes a conical tensioning surface.

6. The vaporizer according to claim 1, wherein the holding sleeve includes an internal thread and the clamping sleeve includes an external thread complementary thereto.

7. The vaporizer according to claim 1, wherein the anti-rotation device is formed by a flat portion of an otherwise circular cross-section of the vaporizer tube.

8. The vaporizer according to claim 1, wherein the anti-rotation device includes a plate-shaped retaining part having a section that is firmly connected with one of the vaporizer tube and the holding sleeve, and having a second section that engages in a recess on one of the holding sleeve and the vaporizer tube.

9. The vaporizer according to claim 1, wherein the holding sleeve has a first end and a second end with an internal bore extending from the first end to the second end to define a center axis, and wherein the vaporizer tube is received within the internal bore such that the vaporizer tube extends axially beyond the first and second ends of the holding sleeve.

10. The vaporizer according to claim 1, wherein the holding sleeve has an outer surface that is configured to be fixed to the exhaust pipe and an inner surface that defines a center axis.

11. The vaporizer according to claim 10, wherein the two circumferentially surrounding clamping surfaces comprise a first clamping surface extending in a first plane that is substantially perpendicular to the central axis and a second clamping surface extending at an obtuse angle relative to the center axis, and wherein the second clamping surface cooperates with the clamping sleeve.

12. The vaporizer according to claim 11, wherein the sealing edge has a sharp edge that digs into the first clamping surface.

13. A vaporizer for an exhaust system of an internal combustion engine, comprising:

a vaporizer tube;

a holding sleeve in which the vaporizer tube is inserted; and a clamping sleeve which sits on the vaporizer tube, wherein at least one of the clamping sleeve and the holding sleeve includes a conical tensioning surface, and wherein the vaporizer tube includes two circumferentially surrounding clamping surfaces which protrude in a radial direction and cooperate with the holding sleeve and the clamping sleeve such that the clamping surfaces are clamped between the holding sleeve and the clamping sleeve by an axial clamping force to be gastight, and wherein at least one of the holding sleeve and the clamping sleeve includes a surrounding sealing edge which rests against the respective clamping surface via line contact and forms an annular sealing seat, and wherein the holding sleeve is inserted in an exhaust pipe and one of the clamping surfaces forms an inclined clamping surface, and the conical tensioning surface and the inclined clamping surface are arranged such that cones open toward an inside of the exhaust pipe.

14. The vaporizer according to claim 13, wherein the holding sleeve includes an internal thread and the clamping sleeve includes an external thread complementary thereto, and wherein the angles of inclination of thread flanks of the internal thread and of the external thread and angles of inclination of the conical tensioning surface and of the inclined clamping surface, each viewed in relation to a center axis of the holding sleeve, are the same.

15. A method of manufacturing a vaporizer, in particular a vaporizer comprising:

a vaporizer tube;

a holding sleeve in which the vaporizer tube is inserted;

a clamping sleeve which sits on the vaporizer tube wherein the vaporizer tube includes two circumferentially surrounding clamping surfaces which protrude in a radial direction and cooperate with the holding sleeve and the clamping sleeve such that the clamping surfaces are clamped between the holding sleeve and the clamping sleeve by an axial clamping force to be gastight, and wherein at least one of the holding sleeve and the clamping sleeve includes a surrounding sealing edge which rests against the respective clamping surface via line contact and forms an annular sealing seat and wherein a heater is inserted in the vaporizer tube, and wherein an outer surface of a holder of the heater and an inner surface of the vaporizer tube are connected with each other by a resistance welding method.

16. The method according to claim 15, wherein an outer surface of a holder of the heater and an inner surface of the vaporizer tube are connected with each other by capacitor discharge welding.

17. A vaporizer for an exhaust system of an internal combustion engine, comprising:

a vaporizer tube that includes an end section which is flared in a funnel shape and in which a heater is inserted, the heater has a holder with a cylindrical section and an outer edge of the cylindrical section is welded to an inside of the end section;

a holding sleeve in which the vaporizer tube is inserted; and a clamping sleeve which sits on the vaporizer tube wherein the vaporizer tube includes two circumferentially surrounding clamping surfaces which protrude in a radial direction and cooperate with the holding sleeve and the clamping sleeve such that the clamping surfaces are clamped between the holding sleeve and the clamping sleeve by an axial clamping force to be gastight, and wherein at least one of the holding sleeve and the clamping sleeve includes a surrounding sealing edge which rests against the respective clamping surface via line contact and forms an annular sealing seat.

* * * * *